United States Patent [19]

Buhler

[11] Patent Number: 5,071,078

[45] Date of Patent: Dec. 10, 1991

[54] METERING AND GRINDING APPARATUS

[75] Inventor: Marcel Buhler, Tolochenaz, Switzerland

[73] Assignee: Nestec S.A., Vevey, Switzerland

[21] Appl. No.: 595,271

[22] Filed: Oct. 9, 1990

[30] Foreign Application Priority Data

Oct. 26, 1989 [CH] Switzerland ..... 03876/89

[51] Int. Cl.[5] ..... B02C 13/286

[52] U.S. Cl. ..... 241/73; 241/74; 241/186 A; 241/189 R

[58] Field of Search ..... 241/73, 74, 186 A, 260.1, 241/DIG. 38, 189 R, 188 R

[56] References Cited

U.S. PATENT DOCUMENTS

| | | | |
|---|---|---|---|
| 1,955,914 | 4/1934 | Holzapfel | 241/186 A X |
| 2,717,742 | 9/1955 | Weigham et al. | 241/260.1 |
| 3,834,630 | 9/1974 | Nelson | 241/186 A X |
| 3,860,182 | 1/1975 | Peterson | 241/186 A |
| 4,752,036 | 6/1988 | McCully . | |

FOREIGN PATENT DOCUMENTS

| | | | |
|---|---|---|---|
| 471509 | 2/1947 | Belgium . | |
| 89865 | 5/1896 | Fed. Rep. of Germany . | |
| 1093319 | 5/1984 | U.S.S.R. | 241/260.1 |
| 1211759 | 11/1970 | United Kingdom . | |
| 1431453 | 4/1976 | United Kingdom . | |
| 2054406 | 2/1981 | United Kingdom . | |
| 2169818 | 7/1986 | United Kingdom . | |

OTHER PUBLICATIONS

Alexanderwerk, "Rotor Fine Granulator Types RFG 350 V/RFG 350 VD/RFG 350 VDL" (1985).

*Primary Examiner*—Mark Rosenbaum

*Attorney, Agent, or Firm*—Vogt & O'Donnell

[57] ABSTRACT

An apparatus for metering and grinding friable material has a metering screw and a beater formed of a plurality of bars which are integral with a downstream end of the metering screw. The bars are positioned parallel to the longitudinal axis of the metering screw, at apexes of a regular polygon centered on the longitudinal axis of the metering screw. A cylindrical housing surrounds the metering screw, and a cylindrical screen at least partially surrounds the beater.

6 Claims, 2 Drawing Sheets

METERING AND GRINDING APPARATUS

BACKGROUND OF THE INVENTION

This invention relates to a machine for metering and grinding friable material.

Known machines for grinding various materials include, for example, hammer mills which comprise a rotor consisting of a rotary shaft to which are connected radial arms that beat the material to be ground against a cylindrical screen at least partly surrounding the rotor.

Another known mill comprises a rotor consisting of a rotary shaft with a flange at either end, bars parallel to the shaft being fixed to the periphery of the flanges and the rotor turning either always in the same direction or alternately in one direction and then the other within a cylindrical screen.

These known grinding machines or mills are generally of sophisticated construction. Obtaining regular grinding or granulation with these known machines requires a regular dosage to ensure a constant charge and a constant level in the mill.

Known feed units which may be used to feed these known mills include, for example, screw feeders, particularly of the type comprising an Archimedean screw or a helical screw. A screw feeder of this type may be accommodated in a cylindrical casing or tube open at its downstream end, a feed hopper being provided at the upstream end of the tube.

SUMMARY OF THE INVENTION

The object of the present invention is to provide a machine for feeding and grinding friable material which is simple in construction by comparison with a screw feeder and comparable in its effectiveness with a hammer mill, for example.

To this end, the machine according to the invention, which is intended for feeding and grinding a friable material, comprises a metering screw, a beater formed by bars which are integral with the helical periphery of the downstream end of the screw, parallel to the longitudinal axis of the screw and distributed along the peaks of a regular polygon centered on that axis, a cylindrical housing surrounding the screw and a cylindrical screen extending the housing and at least partly surrounding the beater.

Surprisingly, a machine such as this effectively combines the properties which, hitherto, it was only possible to achieve by the series connection of at least two machines of which one, the mill, was generally of sophisticated construction.

The machine according to the invention, which is simple and robust in construction, has proved to be particularly effective for the regular feeding and grinding of various friable materials of the type encountered, for example, in the food industry, particularly grains of starch-containing products or cereals, fragments of dehydrated products or flakes of puree dehydrated on a cylinder.

DETAILED DESCRIPTION OF THE INVENTION

In the machine according to the invention, the metering screw may assume various forms, such as for example an Archimedean screw, a screw having a solid cylindrical body with a helical projection around its periphery or a hollow helical screw, in other words a helix.

In cases where the metering screw is made in the form of a helix, the helix itself may have various cross-sections, i.e., circular, square or the like, depending on the type of material to be fed.

Similarly, the bars of the beater may have various cross-sections, i.e., circular, square or the like, depending on the type of material to be ground and, in particular, on the mesh width of the screen.

In one particular embodiment, the metering screw is made in the form of a helix of square cross-section while the bars of the beater have a circular cross-section smaller than or equal in diameter to the side of the square cross-section of the spiral.

The downwstream ends of the bars preferably terminate in one and the same plane perpendicular to the longitudinal axis of the metering screw and may be fixed in notches formed in the periphery of a circular flange for example.

In another preferred embodiment, the machine is provided with a feed hopper at the upstream end of the metering screw which is connected to a drive means, such as an electric motor for example.

BRIEF DESCRIPTION OF THE DRAWINGS

The machine according to the invention is described hereinafter with reference to the accompanying drawings.

DETAILED DESCRIPTION OF THE DRAWINGS

Figure 1:
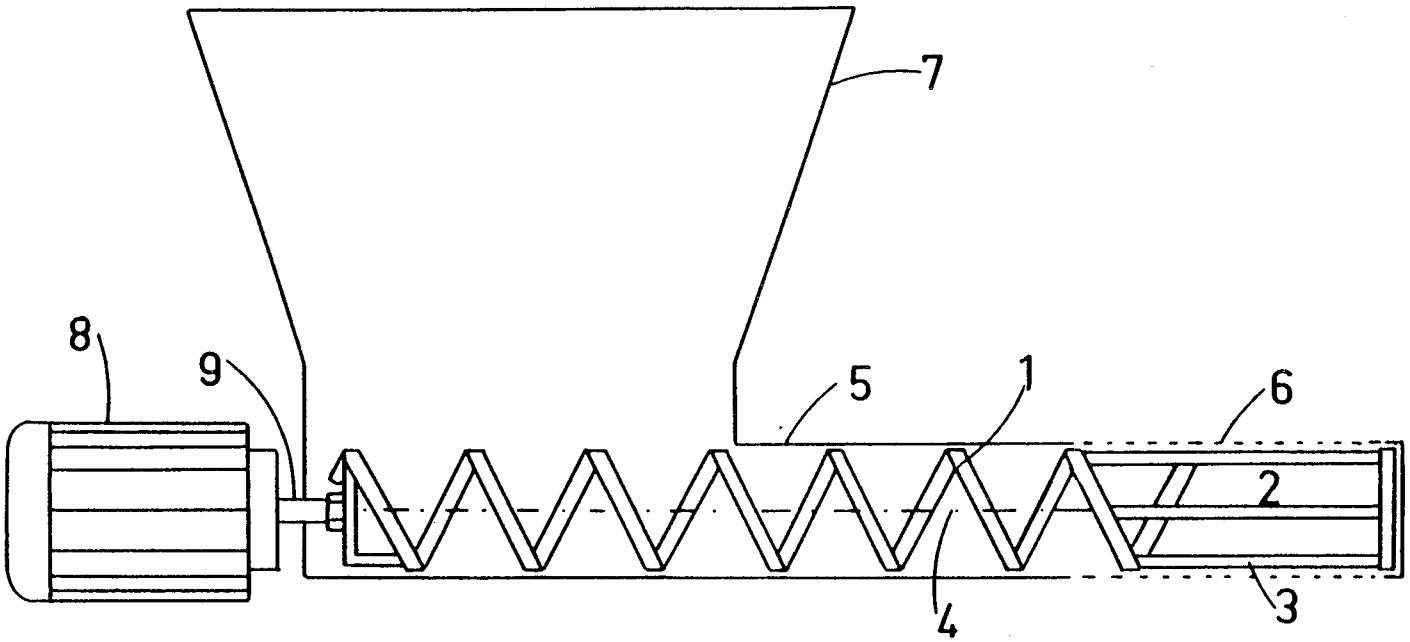
FIG. 1 is a diagrammatic view, partly in longitudinal section, of one embodiment of an apparatus according to the present invention.

In the embodiment shown in FIG. 1, the machine according to the invention comprises a metering screw 1, a beater 2 formed by bars 3 which are integral with the helical periphery of the downstream end of the screw 1, a cylindrical housing 5 surrounding the screw 1 and a cylindrical screen 6 which extends the housing 5 and at least partly surrounds the beater 2.

The machine is provided with a feed hopper 7 at the upstream end of the metering screw 1. The metering screw is connected to an electrical motor 8 by a rotary shaft 9 to which it is fixed.

Figure 2:
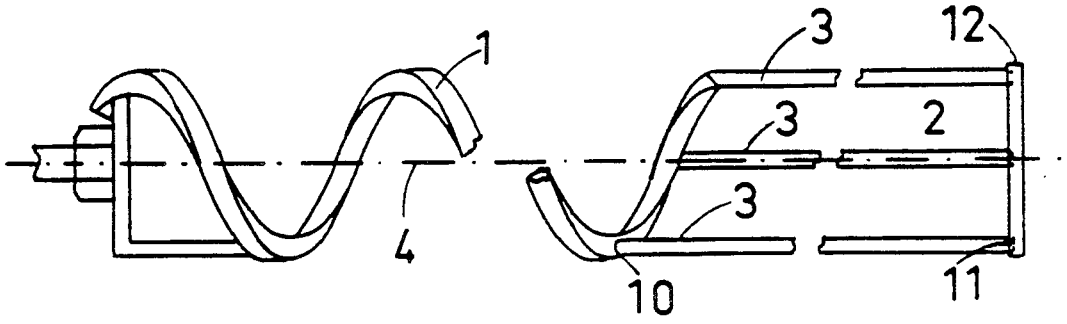
FIG. 2 is a lateral view of the metering screw and the beater of the embodiment shown in FIG. 1.

As shown in FIG. 2 in particular, the metering screw 1 is in the form of a helix of square cross-section. The bars 3 of the beater 2 are parallel to the longitudinal axis 4 of the helix 1. They have a circular cross-section smaller in diameter than the side of the square cross-section of the helix 1. Their upstream ends 10 are accommodated and welded in cylindrical recesses formed in the helix itself.

The downstream ends 11 of the bars 3 terminate in one and the same plane and are fixed and welded in recesses or notches formed in the periphery of a circular flange 12 coaxial with and perpendicular to the axis 4 of the helix 1.

Figure 3:
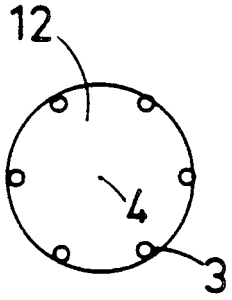
FIG. 3 is a front view - taken downstream of the beater of the embodiment shown in FIG. 1.

As shown in particular in FIG. 3, there are six bars which are distributed at the apices of a hexagon.

I claim:

1. An apparatus for metering and grinding friable material comprising:

(a) a metering screw having an upstream end and a downstream end and having a longitudinal axis;

(b) a beater formed by a plurality of bars which are integral with the downstream end of the metering screw, which are parallel to the longitudinal axis of the metering screw, and which are positioned at apexes of a regular polygon centered on the longitudinal axis of the metering screw;

(c) a cylindrical housing surrounding the metering screw; and (d) a cylindrical screen at least partly surrounding the beater.

2. An apparatus according to claim 1 wherein the metering screw is in a form of a helix.

3. An apparatus according to claim 1 wherein the beater has six bars.

4. An apparatus according to claim 1 wherein the metering screw is in a form of a helix of square cross-section and wherein the bars of the beater have a circular cross-section no greater than equal in diameter to a side of the square cross-section of flights of the screw.

5. An apparatus according to claim 1 wherein the bars are connected to a circular flange at an end away from the metering screw in a plane perpendicular to the axis of the metering screw.

6. An apparatus according to claim 1 further comprising a feed hopper connected to the housing at the upstream end of the metering screw.

* * * * *